US008471136B2

(12) United States Patent
Fuller

(10) Patent No.: US 8,471,136 B2
(45) Date of Patent: Jun. 25, 2013

(54) TWO-STAGE MUSICAL INSTRUMENT EFFECTS PEDAL

(75) Inventor: Michael Fuller, Culver City, CA (US)

(73) Assignee: Fulltone Musical Products, Inc., Culver City, CA (US)

( * ) Notice: Subject to any disclaimer, the term of this patent is extended or adjusted under 35 U.S.C. 154(b) by 52 days.

(21) Appl. No.: 13/018,186

(22) Filed: Jan. 31, 2011

(65) Prior Publication Data

US 2012/0192703 A1 Aug. 2, 2012

(51) Int. Cl.
*G10H 1/32* (2006.01)

(52) U.S. Cl.
USPC ..... 84/721; 84/662; 84/718; 84/743; 84/746; 84/225; 84/229

(58) Field of Classification Search
None
See application file for complete search history.

(56) References Cited

U.S. PATENT DOCUMENTS

| | | | | |
|---|---|---|---|---|
| 4,852,444 | A * | 8/1989 | Hoover et al. | 84/738 |
| 5,022,305 | A * | 6/1991 | Butler | 84/711 |
| 5,981,862 | A * | 11/1999 | Geier, Jr. | 84/746 |
| 7,522,735 | B2 * | 4/2009 | Van Tassel | 381/63 |
| 2005/0089175 | A1 * | 4/2005 | Van Tassel | 381/63 |

* cited by examiner

*Primary Examiner* — Marlon Fletcher
(74) *Attorney, Agent, or Firm* — Pearl Cohen Zedek Latzer, LLP

(57) ABSTRACT

An effects pedal including a first stage configured to asymmetrically limit an input signal, and a second stage configured to symmetrically clip the asymmetrically limited signal.

7 Claims, 2 Drawing Sheets

TWO-STAGE MUSICAL INSTRUMENT EFFECTS PEDAL

BACKGROUND

Musicians playing electronic instruments may alter the sound of the instrument by modifying properties of the instrument's electronic signals using devices that receive the electronic signal prior to being recorded and/or amplified and passed to a speaker. Effect pedals may be a sound-altering device favored by guitar players because it can be foot-operated. A basic effects pedal may include a footswitch, one or two potentiometers, and a power indicating lamp. The effects pedal may modify the sound of various effects including distortion, overdrive, fuzziness, noise reduction, etc.

Distortion and overdrive units distort the tone of an instrument by adding overtones—i.e., a frequency higher than the fundamental frequency. A gritty sound may be added using a unit that reshapes or clips the sound signal, so that they have a flat peak as opposed to a rounded one. Distortion effect units may produce roughly the same amount of distortion at any volume. Overdrive effect units may produce a cleaner sound at lower volume and a distorted sound at higher volume. One type of distortion unit is a fuzzbox which may clip a sound wave to almost a square wave appearance, thereby producing a signal with heavy (e.g., fuzzy) distortion.

DETAILED DESCRIPTION

In accordance with an embodiment of the invention, an effects pedal is provided that may include a two-stage arrangement. In one implementation, the effects pedal may be a distortion style of pedal that may be capable of emulating the sound and feel of a guitar tube amplifier being driven into distortion without having to actually overdrive the amplifier itself.

An embodiment of the invention may include a first stage which may perform asymmetrical, soft limiting of the guitar signal. The DC bias of the asymmetrical limiting done by the first stage contributes to the tube amplifier emulation. The output of the first stage may drive a second gain stage which may be capable of driving a pair of LEDs that progressively clip the signal in a symmetrical fashion. The LEDs are returned to the bias voltage of both opamps and output buffer transistor slightly changing their operating point. This emulates the power tube sag that may be experienced with a tube-based guitar amplifier (particularly one that uses a tube rectifier) when the output is being over-driven.

Figure 1:
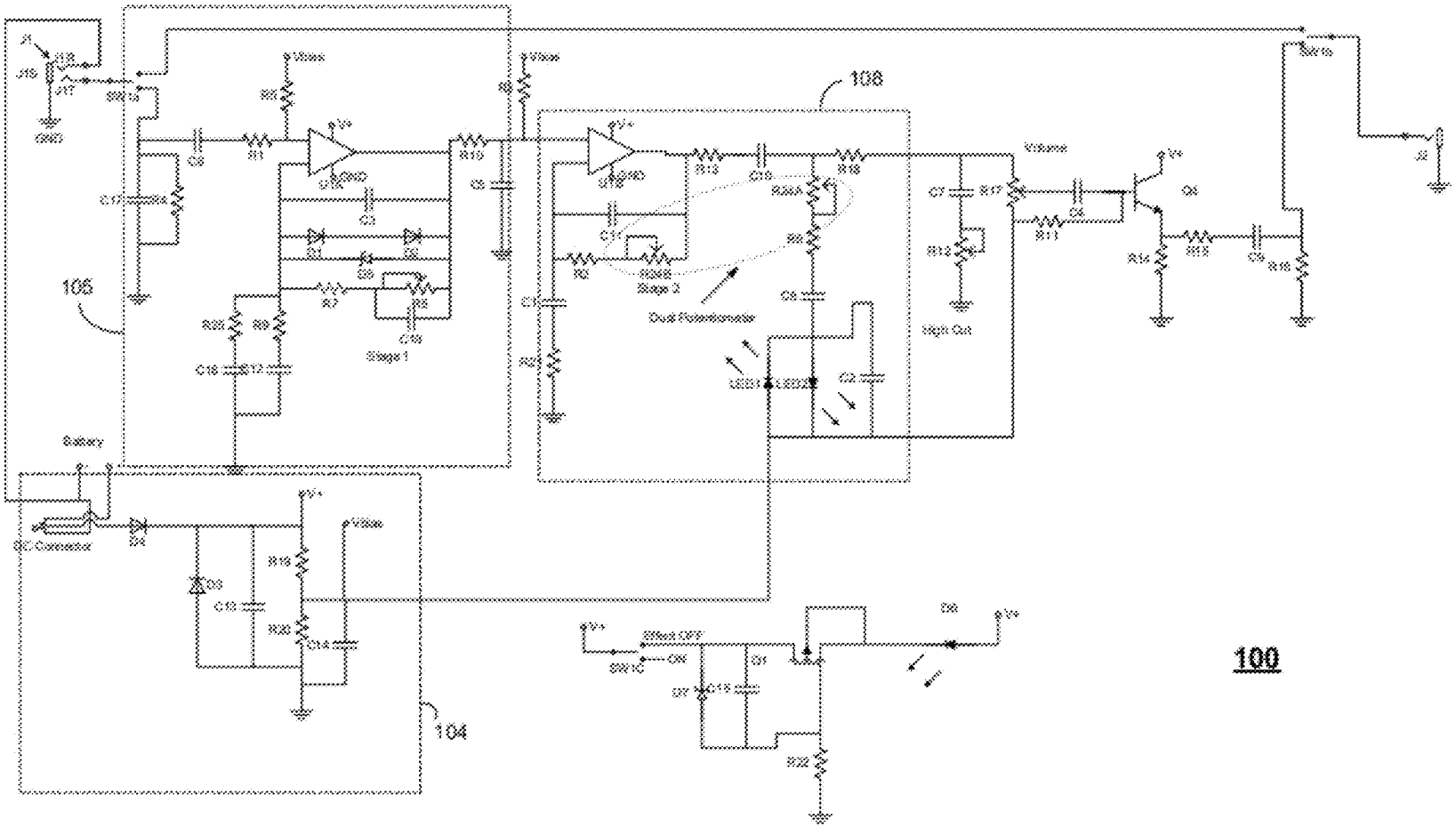
FIG. 1 illustrates a schematic of an effects pedal in accordance with an embodiment of the invention.

FIG. 1 illustrates a schematic of effects pedal 100 in accordance with an embodiment of the invention. Effects pedal 100 may include first stage 105 and second stage 108. First stage 105 may include operational amplifier (opamp) U1A and its associated bias and feedback circuitry. When switch SW1A is in a first position, opamp U1A may receive at its non-inverting input an input signal from an electronic instrument having its output jack connected to input jack J1. The input signal is biased by a resistor divider formed by resistors R19 and R20. This bias voltage is coupled to the non-inverting input of the first stage 105 through resistor R5. The resistor R4 insures no DC is present on the input from the switch when the effect is bypassed. Otherwise known as an "anti-pop" resistor. C17 shunts to ground any RF that may be present on the input. R1 limits the current on the non-inverting input of first stage 105. This protects the input from large input signals and ESD. The bias itself is a function of Vbias (discussed below). Potentiometer R8 controls the gain of opamp U1A by adjusting the signal level at the inverting input of opamp U1B. This feedback signal may be soft-limited by series connected back-to-back diodes D1, D2 in parallel with Zener diode D5. When the output signal is greater than the drop of the two series PN junctions of diodes D1, D1 in the negative direction, the diodes conduct instantaneously reducing the gain of the opamp to unity. When the output signal is greater than the forward voltage drop of the Zener diode D5 in the positive direction, the Zener diode conducts, instantaneously reducing the gain to unity. The shape of the voltage 'knee' of the PN junction of the diodes has a perceptible influence on the overtones produced by the First Stage 105. Facing back-to-back diodes D1, D2 and Zener D5 in different directions may provide an asymmetrical limit to the range of the feedback signal.

Resistor capacitor network R25, R9, C16, C12 may provide a stepped response in the low frequency range. The gain of first stage 105 may roll off before the break point set by resistor/capacitor branch R25, C16 (34 Hz). Above this frequency the gain may be controlled by resistors R25, R7 and the value of potentiometer R8. Between about 34 Hz and about 1 kHz, the gain control may be dominated by the combination of resistors R9, R25 and capacitor C12. The range of gain available between about 34 Hz and about 1 kHz may vary with the setting of potentiometer R8 from about 1-100 at about 34 kHz, and about 1-1500 at about 1 kHz. Above about 1 kHz the gain range remains flat at about 1-1500 until approximately about 5 kHz (if potentiometer R8 is at full resistance) where the gain may start to reduce again due to the effect of high frequency capacitor C18. At the output of opamp U1A may be resistor/capacitor network R10, C5 which may form a low pass filter for input into second stage 108 with a corner frequency at about 1.6 kHz.

Input jack J1 may be a standard three channel (tip/ring/sleeve) audio jack. The signal channel (e.g., tip) may be connected via terminal J1T to input switch SW1A when an audio plug is inserted into input jack J1. Ground between the source (e.g., electronic musical instrument) and effects pedal 100 is maintained via terminal J1S and the plug sleeve. The plug ring may contact power terminal J1R to provide a path from the circuit ground to the input power ground acting as the power switch. A reverse polarity protection circuit comprised of diode D4 and diode D3 may prevent damage to the circuit if mistakenly connected to a power supply with a positive center conductor and negative sleeve. By using the source's plug ring as a connection to ground, it may be possible to eliminate a power switch for the effects pedal.

Bias voltage Vbias may be formed by a bias network within power supply circuit 104. The bias network may include a voltage divider formed by resistors R19, R20 and filtered by capacitor C14. The voltage divider may be designed so that Vbias is equal to half the supply voltage (e.g., 9 volts).

Switch SW1 is a three-pole (SW1A, SW1B, SW1C), double-throw switch. In a first position, as described above, SW1A connects an input signal to an input of opamp U1A. In a second position, switch SW1A connects the input signal to a bypass path. The bypass path leads to switch SW1B, which in the second position provides the input signal to output jack J2. In the first position, switch SW1B provides the output of the effects pedal to output jack J2.

Second stage 108 receives the asymmetrically-clipped, low pass-filtered output of first stage 105 at the non-inverting input to opamp U1B. Opamp U1B may be configured as a variable gain amplifier. Gain control may be achieved by dual potentiometer R24. As the resistance is increased in first potentiometer R24B, the feedback signal level at opamp U1B inverting input is reduced. This reduction in feedback causes an increase in the gain of opamp U2*b* with a commensurate increase in output signal level. Thus, the output signal level of the operational amplifier is in direct proportion to the resistance level of first potentiometer R24B. The first potentiometer and the second potentiometer in dual potentiometer R24 are configured to have opposite changes in resistance as the dual potentiometer is adjusted.

As the resistance of first potentiometer R24B is increased, the resistance of second potentiometer R24B decreases. The reduction of resistance in second potentiometer R24B may reduce the series resistance in-line with back-to-back light emitting diodes LED1, LED2 causing these light emitting diodes to increasingly clamp the output signal from opamp U1B. One of back-to-back light emitting diodes LED1, LED2 may glow on complimentary portions of the analog signal.

As the gain of second stage 108 increases (due to a reduction in resistance of potentiometer R24B) the signal may be clipped progressively more aggressive (e.g., 'harder'). Resistor R6 limits the maximum that the back-to-back light emitting diodes can clamp the signal with R24 adjusted to the maximum gain setting.

There may be a DC bias to the waveform because the output of first stage 105 may be limited asymmetrically. The amount of this DC bias is proportional to the signal amplitude. This DC bias 'passes through' back-to-back light emitting diodes LED1, LED2 in the output portion of second stage 108. Because back-to-back light emitting diodes LED1, LED2 are connected to opamp bias voltage Vbias (which may be ½ VCC), the bias voltage itself may 'sag'. The term "sag" refers to the drooping of the power supply voltage in a tube guitar amplifier in response to large transient signals. Sag may affect the produced sound to yield an audible feel from a tube amplifier that is not generally found in solid-state amplifiers. In accordance with an embodiment of the invention, the recovery time of the sag may be dominated by the bias network within power regulation circuit 104 formed by resistors R19, R20 and capacitor C14.

Figure 2:
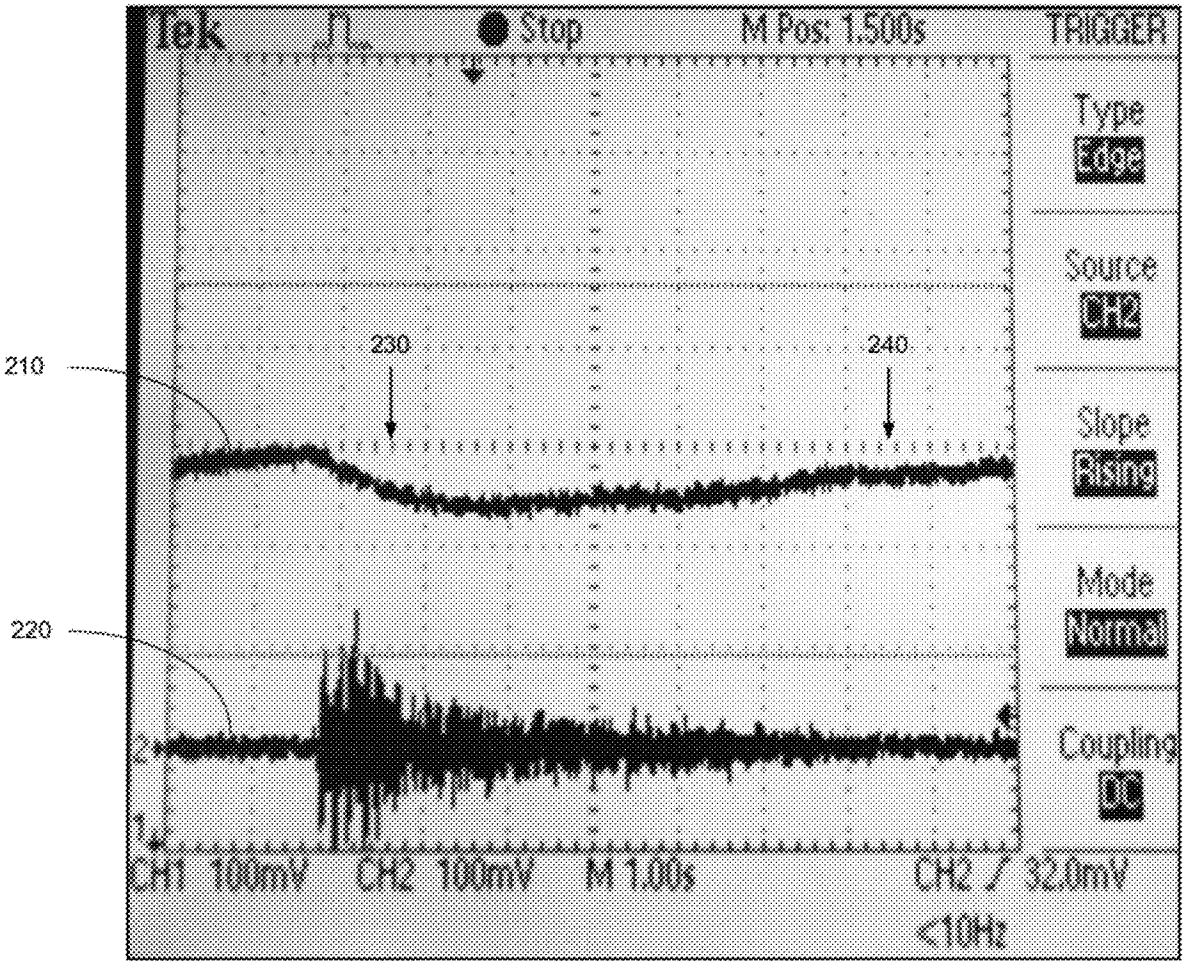
FIG. 2 illustrates a measured waveform of bias voltage and input signal in accordance with an embodiment of the invention.

FIG. 2 illustrates a measured waveform for bias voltage Vbias and an input signal in accordance with an embodiment of the invention. Top trace 210 is Vbias and bottom trace 220 is a guitar signal input. As can be seen, large transients in the guitar signal cause a 'sag' in the bias voltage (region 230). As the note or chord starts to decay, the bias voltage returns to its level (region 240).

In accordance with an embodiment of the invention, the emulation of tube amplifier power supply drooping (e.g., 'sag') by second stage 108 in combination with the emulation of a tube pre-amplifier distortion by the asymmetrical limiting of first stage 105 creates the sound and feel of an overdriven tube amplifier.

Because the effect of first stage 105 may be controlled by potentiometer R8, and the effect of second stage 108 may be controlled by dual potentiometer R24, each effect may be used independently or in conjunction to achieve a combined effect.

A passive high-cut network may include resistor R18, capacitor C7, and potentiometer R12. The network of resistor R18 and capacitor C7 may form a low pass filter with a corner frequency of approximately about 360 Hz. The maximum amount of high frequency attenuation may be set by potentiometer R12. With potentiometer R12 set to minimum resistance, the high-cut network may roll off at about a 6 dB/Octave slope starting at about 360 Hz. With potentiometer R12 set to maximum resistance, the frequency may roll off at about 6 dB/Octave starting at 360 Hz until it reaches a maximum attenuation of about 18% of the input amplitude.

An emitter follower buffer for the signal coming from the volume control variable resistor R17 may be formed by transistor Q4, capacitors C4, C9, and resistors R11, R17, R14, R15, R16. Resistor R11 provides the DC bias for transistor Q4. Blocking capacitor C4 prevents DC current from the wiper of variable resistor R17 from reaching the base of transistor Q4 to prevent undesirable noise. The output impedance may be limited by resistor R15 which may protect Q4 from a short-circuited output. Capacitor C9 acts as a DC block for the output signal and resistor R16 may prevent a DC voltage from building up on the output side of capacitor C9 which would cause audible 'popping' when the effect was switched from bypass.

Indicators LED D6 may be switched in a soft manner by the circuit formed from capacitor C15, transistor Q1, Zener diode D7, and resistor R22. Soft switching may prevent sudden or abrupt switching currents from coupling into the audio path. With switch SW1C connected to the power supply (the second position (e.g., bypass mode) of switch SW), the drain and source of transistor Q1 are at the same potential and no current flows through LED D6. Therefore, the LED is not illuminated. When switch SW1C is not connected to the power supply (open) (the first position of switch SW1C), capacitor C15 slowly discharges through Zener diode D7 which gradually allows LED D6 to illuminate. Resistor R22 limits the current that can flow through the LED, thus setting the brightness.

While there have been shown and described fundamental novel features of the invention as applied to one or more embodiments, it will be understood that various omissions, substitutions, and changes in the form, detail, and operation of these embodiments may be made by those skilled in the art without departing from the spirit and scope of the invention. Substitutions of elements from one embodiment to another are also fully intended and contemplated. The invention is defined solely with regard to the claims appended hereto, and equivalents of the recitations therein.

I claim:

1. An effects pedal comprising:

a first stage configured to asymmetrically limit an input signal; and a second stage configured to symmetrically clip the asymmetrically limited signal, the second stage including:

a dual stage potentiometer having a first potentiometer and a second potentiometer, the second potentiometer configured to have a resistance change opposite to a resistance change in the first potentiometer, wherein the second potentiometer is in series with a pair of parallel diodes at a first junction, an anode of one of the pair of parallel diodes in connection with a cathode of an other of the pair of parallel diodes at the first junction;

an operational amplifier having a feedback loop including the first potentiometer, wherein a level of an output signal from the operational amplifier is in direct proportion to a change in resistance level of the first potentiometer; and a bias voltage at the input to the operational amplifier, wherein:

at a second junction, the bias voltage is connected to a cathode of the one of the pair of parallel diodes, and an anode of the other of the pair of parallel diodes; and the pair of parallel diodes is configured to clip an output of the operational amplifier in inverse proportion to a resistance change of the second potentiometer.

2. The effects pedal of claim 1, the first stage including:

an operational amplifier having a feedback loop that includes a potentiometer in parallel with a pair of series connected diodes and in parallel with a Zener diode.

3. The effects pedal of claim 2, wherein an anode of the Zener diode is connected to a cathode of the series connected diodes and a cathode of the Zener diode is connected to an anode of the series connected diodes.

4. The effects pedal of claim 2, the feedback loop including a resistor capacitor network configured to provide a stepped response in a low frequency range of the input signal.

5. The effects pedal of claim 4, wherein a range of gain between about 34 Hz and about 1 kHz is about 1-100.

6. The effects pedal of claim 4, wherein a range of gain between about 1 kHz and 5 kHz is about 1-1500.

7. The effects pedal of claim 1, wherein the pair of parallel diodes causes a DC feedback signal to the bias voltage to emulate the sag of a tube amplifier.

* * * * *